US007445493B2

(12) United States Patent
Takahira

(10) Patent No.: US 7,445,493 B2
(45) Date of Patent: Nov. 4, 2008

(54) CONNECTOR FOR A FLEXIBLE CONDUCTOR

(75) Inventor: Hiroshi Takahira, Kawasaki (JP)

(73) Assignee: Yamaichi Electronics Co., Ltd, Tokyo (JP)

( * ) Notice: Subject to any disclaimer, the term of this patent is extended or adjusted under 35 U.S.C. 154(b) by 0 days.

(21) Appl. No.: 11/516,561

(22) Filed: Sep. 7, 2006

(65) Prior Publication Data

US 2007/0054545 A1 Mar. 8, 2007

(30) Foreign Application Priority Data

Sep. 8, 2005 (JP) ..... 2005-260695

(51) Int. Cl.
*H01R 12/24* (2006.01)

(52) U.S. Cl. ..... 439/495

(58) Field of Classification Search ..... 439/495, 439/260, 492

See application file for complete search history.

(56) References Cited

U.S. PATENT DOCUMENTS 4,189,200 A 2/1980 Yeager et al.
4,630,874 A 12/1986 Renn et al.
5,458,506 A 10/1995 Yamaguchi et al.
5,580,257 A 12/1996 Harwath
5,709,573 A 1/1998 McClure
5,953,815 A 9/1999 Kaminski et al.
5,954,521 A 9/1999 Yang
6,056,571 A * 5/2000 Noro ..... 439/260
6,099,346 A 8/2000 Hashiguchi et al.
6,123,558 A 9/2000 Shibata
6,126,472 A 10/2000 Choy
6,162,083 A 12/2000 Seto
6,176,737 B1 1/2001 Choy (Continued)

FOREIGN PATENT DOCUMENTS

EP 0 933 837 A1 8/1999

(Continued)

OTHER PUBLICATIONS

Chinese Office Action and English Translation for Chinese Patent Application No. 2004100807089, dated Mar. 10, 2006.

(Continued)

*Primary Examiner*—Neil Abrams
*Assistant Examiner*—Phuong Nguyen
(74) *Attorney, Agent, or Firm*—Finnegan, Henderson, Farabow, Garrett & Dunner, LLP

(57) ABSTRACT

A connector for a flexible conductor includes a connector body, a plurality of contacts provided in the connector body, an operator capable of vertically moving between a first position and a second position within the connector body, and a driver capable of moving between a first position and a second position relative to the connector body. The driver causes the operator to move vertically between the first and second positions correspondingly to a movement thereof between the first and second positions. The operator, in the first position, is in a position distant a predetermined spacing from the plurality of contacts so that a flexible conductor can be placed between the operator and the plurality of contacts, and, in the second position, is allowed to bring external terminals of the flexible conductor into contact, at a predetermined contact pressure, with the plurality of contacts.

18 Claims, 10 Drawing Sheets

U.S. PATENT DOCUMENTS

| | | | | |
|---|---|---|---|---|
| 6,203,345 | B1 | 3/2001 | Roque et al. | |
| 6,210,174 | B1 | 4/2001 | Pei et al. | |
| 6,210,209 | B1 | 4/2001 | Wu et al. | |
| 6,261,106 | B1 | 7/2001 | Tung | |
| 6,267,620 | B1 * | 7/2001 | Ma | 439/495 |
| 6,383,017 | B1 | 5/2002 | Takayasu | |
| 6,431,897 | B1 | 8/2002 | Hashiguchi et al. | |
| 6,475,025 | B2 * | 11/2002 | Inoue | 439/495 |
| 6,506,074 | B2 | 1/2003 | Hashimoto | |
| 6,676,444 | B2 | 1/2004 | Noro | |
| 6,755,682 | B2 | 6/2004 | Kunishi et al. | |
| 6,767,233 | B2 | 7/2004 | Tsunematsu | |
| 6,790,074 | B1 | 9/2004 | Chiu | |
| 6,851,968 | B2 | 2/2005 | Tsunematsu | |
| 6,855,009 | B2 | 2/2005 | Nishiyama | |
| 6,863,559 | B2 | 3/2005 | Yu | |
| 6,869,307 | B2 | 3/2005 | Endo | |
| 6,921,274 | B2 | 7/2005 | Yu | |
| 6,951,476 | B1 * | 10/2005 | Saito et al. | 439/495 |
| 6,971,908 | B2 | 12/2005 | Shiu et al. | |
| 7,101,188 | B1 | 9/2006 | Summers et al. | |
| 7,112,079 | B2 * | 9/2006 | Miura et al. | 439/260 |
| 2002/0119704 | A1 | 8/2002 | Ito et al. | |
| 2003/0092310 | A1 | 5/2003 | Kunishi et al. | |
| 2005/0075004 | A1 | 4/2005 | Endou et al. | |
| 2006/0172590 | A1 | 8/2006 | Yamada et al. | |
| 2006/0189175 | A1 | 8/2006 | Kinsley | |

FOREIGN PATENT DOCUMENTS

| | | | |
|---|---|---|---|
| JP | 59-110990 | U | 7/1984 |
| JP | 63-83779 | U | 6/1988 |
| JP | 07-057825 | | 3/1995 |
| JP | 8-148222 | A | 6/1996 |
| JP | 08-306446 | | 11/1996 |
| JP | 09-293571 | | 11/1997 |
| JP | 11-121108 | | 4/1999 |
| JP | 2000-133351 | | 5/2000 |
| JP | 2000-251024 | | 9/2000 |
| JP | 2000-251025 | | 9/2000 |
| JP | 2002-270261 | A | 9/2002 |
| JP | 03-425696 | | 5/2003 |
| JP | 2003-272774 | | 9/2003 |

OTHER PUBLICATIONS

Co-Pending U.S. Appl. No. 10/954,491; Title: Connector for Flexible Printed Circuit Board; U.S. Filing Date: Oct. 1, 2004.

Co-Pending U.S. Appl. No. 11/480,830; U.S. Filing Date: Jul. 6, 2006.

Co-Pending U.S. Appl. No. 11/585,823; U.S. Filing Date: Oct. 25, 2006.

Office Action in co-pending U.S. Appl. No. 10/400,678, dated Jun. 10, 2004 (EX. Prasad).

Office Action in co-pending U.S. Appl. No. 10/464,538, dated Jun. 8, 2004 (Ex. Nasri).

Office Action in co-pending U.S. Appl. No. 10/954,491, dated Jan. 24, 2006 (Ex. Figueroa).

Office Action in co-pending U.S. Appl. No. 10/954,491, dated Sep. 2, 2005 (Ex. Figueroa).

Office Action in co-pending U.S. Appl. No. 11/480,830, dated Nov. 6, 2006 (Ex. Imas).

Office Action in co-pending U.S. Appl. No. 10/954,491, dated Feb. 23, 2007 (Ex. Figueroa).

Office Action in co-pending U.S. Appl. No. 11/480,830. dated Mar. 30, 2007 (Ex. Imas).

Official Notice of Rejection of Japanese Patent Office for corresponding Japanese Patent Application No. 2004-239954, dated Oct. 16, 2007.

Office Action in co-pending U.S. Appl. No. 11/585,823, now U.S. Patent No. 7,273,381, dated May 24, 2007.

Office Action in co-pending U.S. Appl. No. 11/480,830, dated Jul. 12, 2007.

Office Action in co-pending U.S. Appl. No. 10/954,491, dated Aug. 30, 2007.

Chinese Office Action and English Translation for Chinese Patent Application No. 200610151635.7 dated Feb. 15, 2008.

* cited by examiner

CONNECTOR FOR A FLEXIBLE CONDUCTOR

This application claims priority from Japanese Patent Application No. 2005-260695 filed Sep. 8, 2005, which is hereby incorporated by reference herein.

BACKGROUND OF THE INVENTION

1. Field of the Invention

The present invention relates to a connector for a flexible conductor which can cope with a flexible conductor, such as a flexible flat cable (hereinafter, referred merely to as an "FFC") or a flexible printed circuit board (hereinafter, referred merely to as an "FPC")

2. Description of the Related Art

There is conventionally known a connector adapted to obtain a required contact pressure between the external terminals on the FFC or FPC, bonded with a reinforcing plate on its backside, and the contacts on the connector through utilization of a slider, as disclosed in Japanese Patent Application Laid-open No. 2000-133351.

It is a recent tendency to eliminate a reinforcing plate from the FFC or FPC, along with decrease in the thickness thereof. This however makes the FFC or FPC easy to deform. The existing connector is structured to bring the FFC or FPC external terminals into contact with the contacts on the connector simultaneously with insertion of a slider. The FFC or FPC if deformed hinders the positive connection to the contacts.

Furthermore, the number of external terminals on the FFC or FPC increases to accommodate electrical devices having increasingly complicated circuits. For this reason, the external terminals tend to be arranged in front and rear positions. The contacts on the connector are also arranged in the front and rear positions. In the existing connector, when the slider moves a distance between the contacts arranged in the front and rear positions, time lag arises upon contacting of the FFC or FPC external terminal with the contact. This however might raise an unfavorable situation.

Meanwhile, due to the increased number of external terminals on the FFC or FPC, there is also a tendency of arranging a grounding external terminal on the backside thereof. With the slider of the existing connector, no connection is available between the grounding external terminal provided on the backside of the FFC or FPC and the grounding contact of the connector. This requires another mechanism, thus complicating the structure further.

It is an object of the present invention to provide a connector for a flexible conductor which can positively bring the FFC or FPC external terminals into contact with the contacts and to simultaneously put the external terminals arranged in the front and rear positions into contact with the contacts in the front and rear positions. Another object of the invention is to provide a connector for a flexible conductor which can bring the grounding contact, arranged at the backside of an FFC or FPC, into contact with the grounding contact of the connector through the use of a driver, such as a slider.

SUMMARY OF THE INVENTION

In accordance with the present invention, there is provided a connector for a flexible conductor, comprising: a connector body; a plurality of contacts provided in the connector body; an operator capable of vertically moving between a first position and a second position, within the connector body; and a driver capable of moving between a first position and a second position, relative to the connector body; wherein the driver causes the operator to move vertically between the first and second positions correspondingly to a movement thereof between the first and second positions, the operator, in the first position, being in a position distant a predetermined spacing from the plurality of contacts so that a flexible conductor can be placed at between the plurality of contacts and the operator, and, in the second position, being allowed to bring external terminals of the flexible conductor into contact, at a predetermined contact pressure, with the plurality of contacts.

Meanwhile, in a connector for a flexible conductor in the invention, there is further comprised of a grounding contact provided in the connector body, wherein operator includes a recess to receive the grounding contact, the operator being allowed, when in the first position, to receive the grounding contact in the recess and, when in the second position, to bring the grounding contact into contact with the grounding external terminals of the flexible conductor.

Meanwhile, in a connector for a flexible conductor in the invention, the connector body is further formed with a convex therein, the operator being further formed with an anti-removal-hole corresponding to the convex, the convex being allowed to engage in the anti-removal hole through an anti-removal concave formed in the flexible conductor when the operator is in the second position.

Furthermore, in a connector for a flexible conductor in the invention, the driver may be a slider capable of moving horizontally relative to the connector body or a cam body capable of rotating relative to the connector body.

Furthermore, the plurality of contacts preferably include first and second contacts whose contact portions differ in the position in the forward and rearward direction and the first contact and the second contact are arranged alternately.

Meanwhile, the operator may have a horizontal upper surface serving as a push surface to push up the flexible conductor toward the contact and a horizontal lower surface, under which the driver can be positioned, parallel with the horizontal upper surface.

With the structure, the invention is allowed to positively bring the external terminals of an FFC or FPC and the contacts into contact at a desired contact pressure by the movement of a driver, such as a slider or a cam body. In this case, contact is available simultaneously between the external terminals arranged in the front and rear positions and the corresponding contacts. Meanwhile, contact is also available between a grounding external terminal arranged in the backside of an FFC or FPC and a grounding contact of the connector, due to movement of the same driver. Furthermore, the FFC or FPC can be prevented against removal by means of the movement of the same driver. Therefore, the invention can perform a plurality of operations at one time by merely moving the driver, thus making it easy to attach or detach a flexible conductor.

The above and other objects, effects, features and advantages of the present invention will become more apparent from the following description of embodiments thereof in conjunction with the accompanying drawings.

DETAILED DESCRIPTION OF THE PREFERRED EMBODIMENTS

With reference to the drawings, description is now made on the embodiments according to the present invention.

First Embodiment

Figure 1:
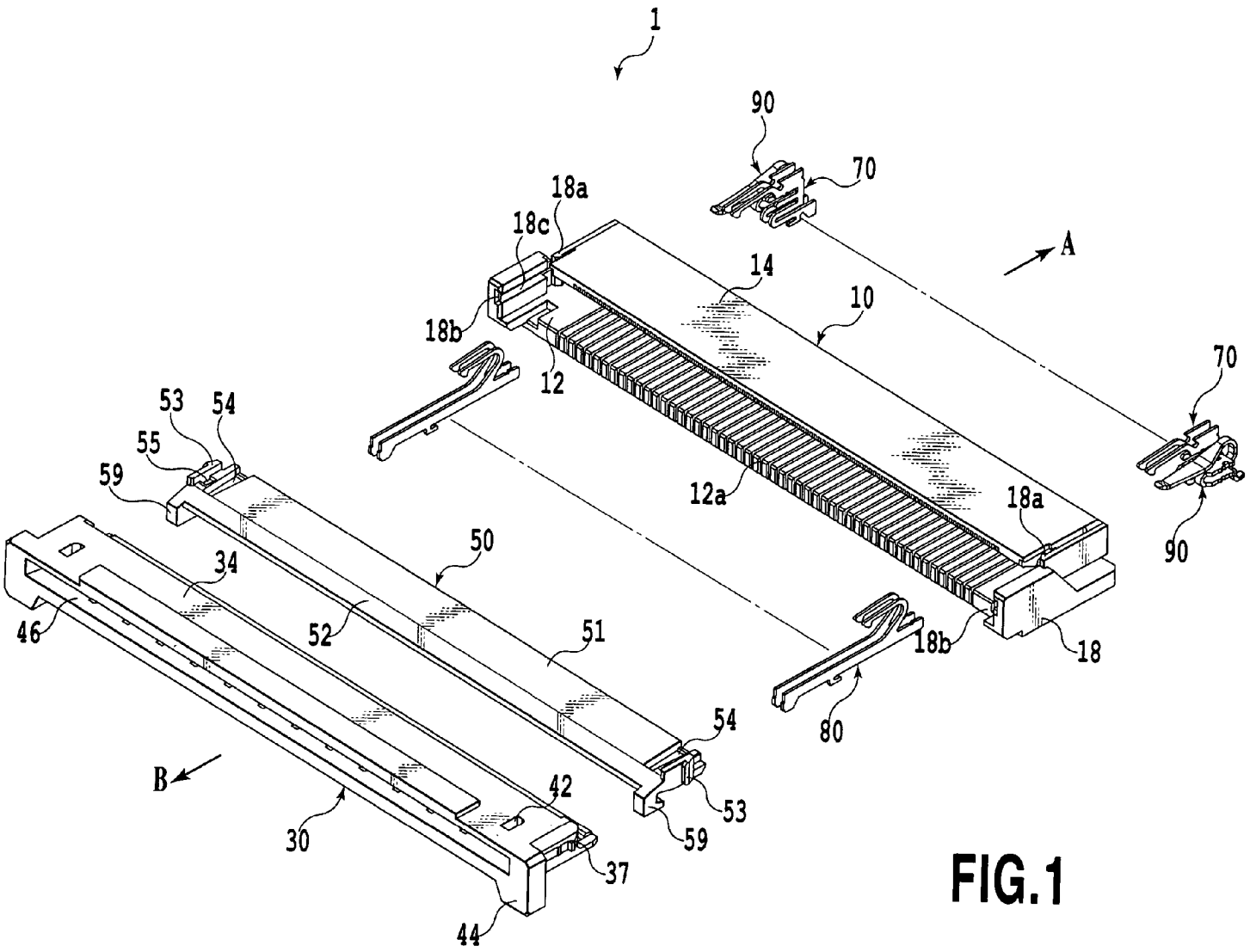
FIG. 1 is a schematic exploded assembly view of a connector for a flexible conductor according to a first embodiment.
Figure 2:
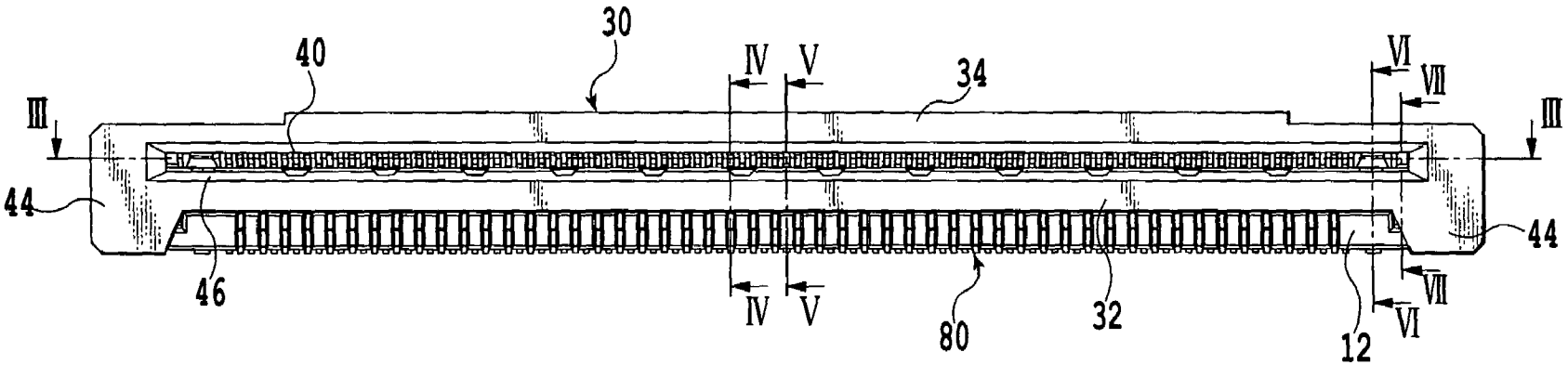
FIG. 2 is a schematic front view of the connector for a flexible conductor shown in FIG. 1.
Figure 3:
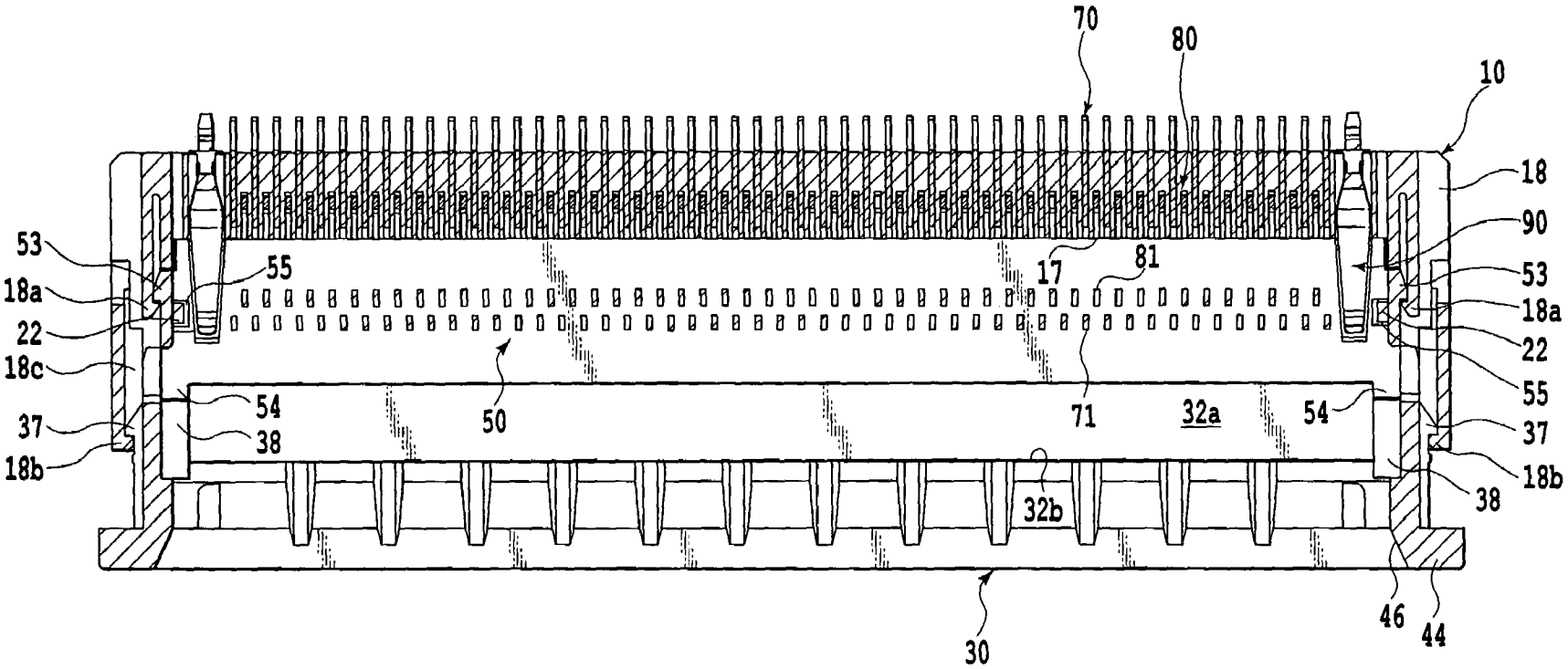
FIG. 3 is a schematic sectional view taken along III-III of the connector for a flexible conductor shown in FIG. 2.
Figure 6A:
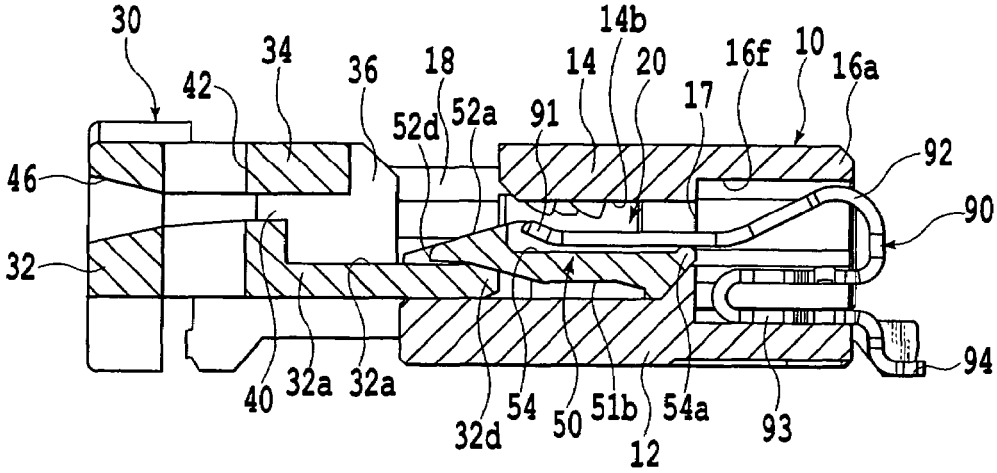
FIG. 6A is a schematic sectional view taken along VI-VI of the connector for a flexible conductor shown in FIG. 2, showing a state not attached with a flexible conductor.
Figure 6B:
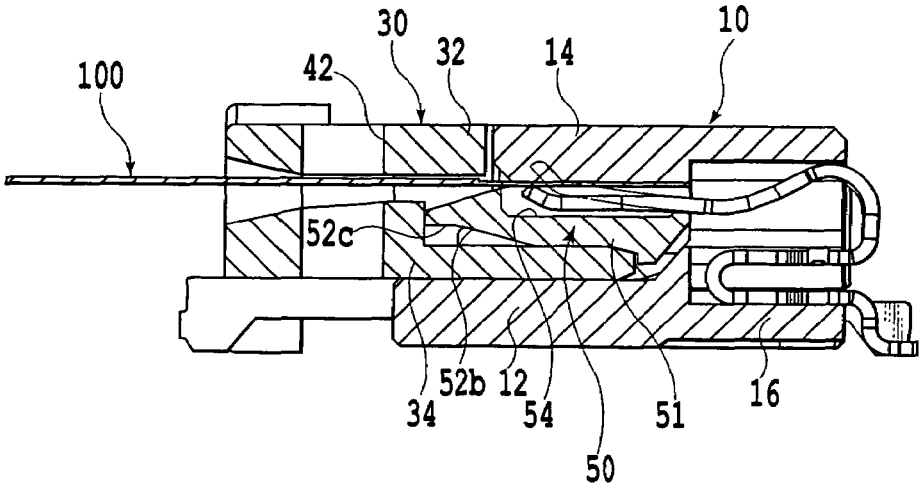
FIG. 6B is a schematic sectional view taken along VI-VI of the connector for a flexible conductor shown in FIG. 2 similarly to FIG. 6A, showing a state attached with a flexible conductor.
Figure 7A:
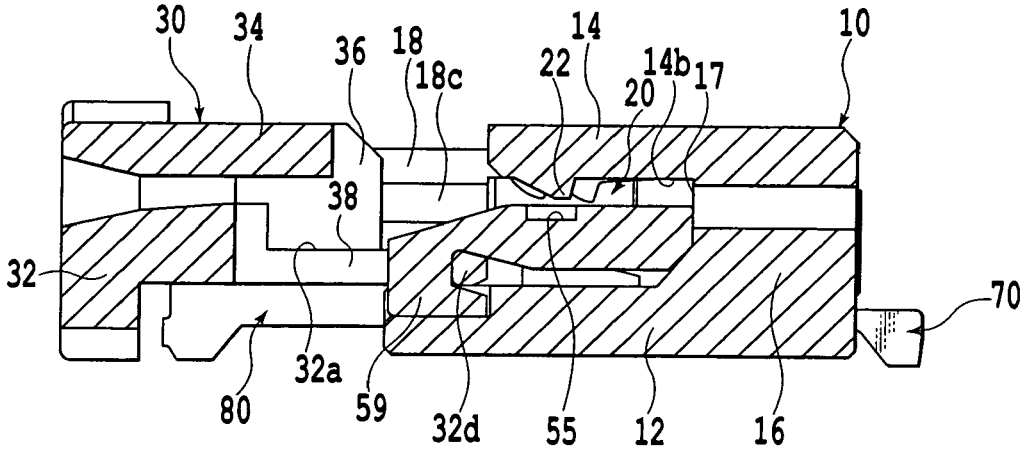
FIG. 7A is a schematic sectional view taken along VII-VII of the connector for a flexible conductor shown in FIG. 2, showing a state not attached with a flexible conductor.
Figure 7B:
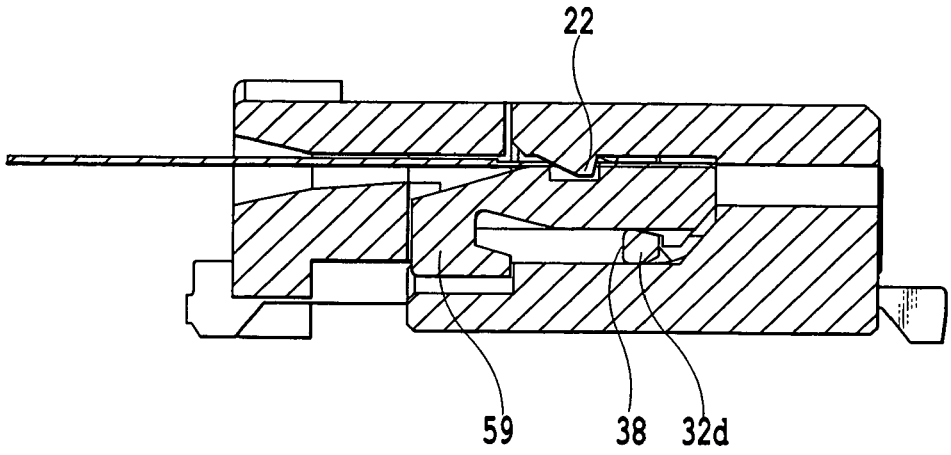
FIG. 7B is a schematic sectional view taken along VII-VII of the connector for a flexible conductor shown in FIG. 2 similarly to FIG. 7A, showing a state attached with a flexible conductor.
Figure 8:
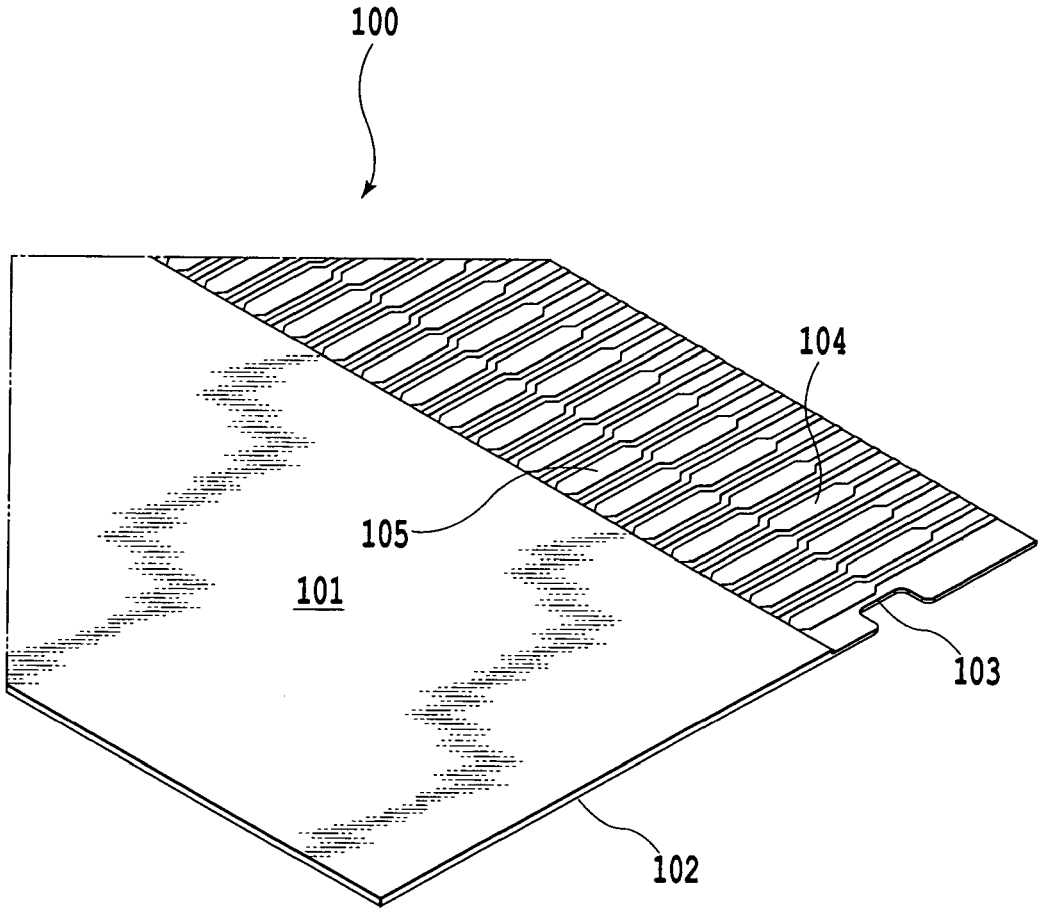
FIG. 8 is a fragmentary schematic perspective view of a flexible conductor to be inserted in the connector for a flexible conductor according to the invention.

FIGS. 1 to 8 show the views illustrating a first embodiment of the present invention. FIG. 1 is a schematic exploded assembly view of a connector for a flexible conductor according to the first embodiment. FIG. 2 is a schematic front view of the connector for a flexible conductor shown in FIG. 1. FIG. 3 is a schematic sectional view, taken along III-III, of the connector for a flexible conductor shown in FIG. 2. FIG. 4A is a schematic sectional view, taken along IV-IV, of the connector for a flexible conductor shown in FIG. 2, showing the connector without a flexible conductor inserted. FIG. 4B is a schematic sectional view, taken along IV-IV, of the connector for a flexible conductor shown in FIG. 2, showing the connector with a flexible conductor inserted. FIG. 5A is a schematic sectional view, taken along V-V, of the connector for a flexible conductor shown in FIG. 2, showing the connector without a flexible conductor inserted. FIG. 5B is a schematic sectional view, taken along V-V, of the connector for a flexible conductor shown in FIG. 2, showing the connector with a flexible conductor inserted. FIG. 6A is a schematic sectional view taken along VI-VI of the connector for a flexible conductor shown in FIG. 2, showing the connector without a flexible conductor inserted. FIG. 6B is a schematic sectional view, taken along VI-VI, of the connector for a flexible conductor shown in FIG. 2 similarly to FIG. 6A, showing the connector with a flexible conductor inserted. FIG. 7A is a schematic sectional view, taken along VII-VII, of the connector for a flexible conductor shown in FIG. 2, showing the connector without a flexible conductor inserted. FIG. 7B is a schematic sectional view, taken along VII-VII, of the connector for a flexible conductor shown in FIG. 2 showing the connector with a flexible conductor inserted. FIG. 8 is a fragmentary schematic perspective view of a flexible conductor to be inserted to the connector for a flexible conductor according to the invention.

Note that the term "rear" or "proximal" used in the description refers to a direction given by the arrow A in FIG. 1 while the term "front" or "distal" used in the description refers to a direction given by the arrow B in FIG. 1.

At the outset, description is made on a flexible conductor 100 by referring to FIG. 8. In this embodiment, the flexible conductor 100 is shown as an FPC as shown in FIG. 8. However, this is not limitative. For example, it may be an FFC. The flexible conductor 100 shown in the embodiment is arranged with first and second external terminals 105,104 in a staggered form on the surface 101 of the end to be attached to the connector 1. FIG. 8 shows these first and second external terminals 104, 105 on an upper surface 101 of the flexible connector 100. Meanwhile, a pair of anti-removal recesses 103 (one shown in the figure) is formed in the respective sides of flexible connector 100. Furthermore, on surface 102 of the flexible conductor 100, a pair of external grounding terminals (not shown) is provided at appropriate positions between the pair of anti-removal recesses 103.

Description is now made on the connector 1 for a flexible conductor according to the present embodiment. The connector 1 has roughly a connector body 10, a plurality of first and second contacts 70, 80, an operator 50, a slider 30 and grounding contacts 90.

The connector body 10 is made as a housing opened at the front, having a bottom wall 12, a top wall 14, a rear wall 16 and left and right side walls 18, 18. Accordingly, within the connector body 10, a space 20 is formed surrounded by the bottom wall 12, the top wall 14, the rear wall 16 and the left and right side walls 18, 18.

Figure 4A:
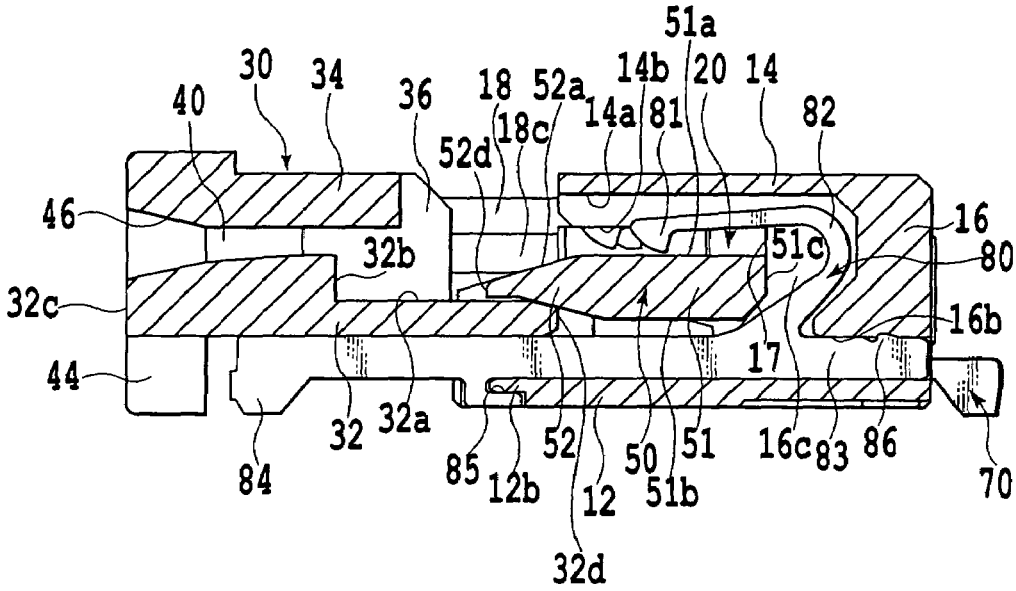
FIG. 4A is a schematic sectional view taken along IV-IV of the connector for a flexible conductor shown in FIG. 2, showing a state not attached with a flexible conductor.
Figure 4B:
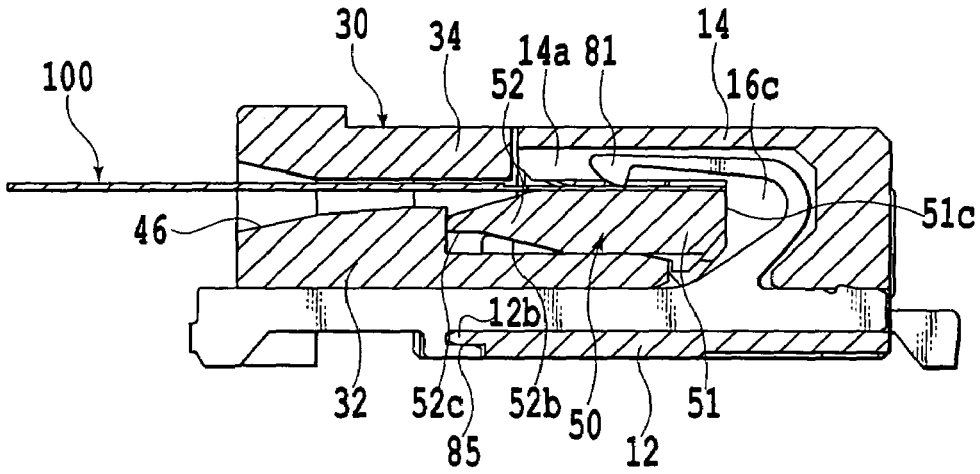
FIG. 4B is a schematic sectional view taken along IV-IV of the connector for a flexible conductor shown in FIG. 2 similarly to FIG. 4A, showing a state attached with a flexible conductor.

In the upper surface of the bottom wall 12, a plurality of lower grooves 12*a* are formed opened at the front so that a second contact 80, referred later, can be inserted from the front. Each of the lower grooves 12*a* is formed opened toward the front and extending, at its front opening end, toward the lower surface of the bottom wall 12, as shown in FIGS. 4A and 4B, thus forming a projection 12*b* for engagement with an engaging concaving 85 of the second contact 80. The engagement between the engaging concaving 85 of the second contact 80 and projection 12*b* of the bottom wall 12 prevents the second contact 80 from moving horizontally. Meanwhile, in the rear of the lower groove 12*a*, a slit-like second contact-fitting hole 16*b* is formed penetrating the rear wall 16 and continuing from the lower groove 12*a* (see FIGS. 4A, 4B). By pressure-fitting a proximal portion of a fixed portion 83 of the second contact 80 into the second contact-fitting hole 16*b*, the second contact 80 is fixed to the connector body 10.

The bottom wall 12 preferably extends further toward the distal end of connector 1 than the top wall 14. Such a structure facilitates assembly of the connector 1.

In the lower surface (surface facing the space 20) 14*b* of the top wall 14, a plurality of upper grooves 14*a* are formed to arrange the contact portion 71 of the first contact 70 and the contact portion 81 of the second contact 80 for vertical displacement. Incidentally, each upper groove 14*a* may accept either one of the contact portion 71 of the first contact 70 or the contact portion 81 of the second contact 80. Preferably, the same type of contact is not arranged in adjacent upper grooves 14*a*. Namely, the first contacts 70 and the second contacts 80 are arranged alternately. The upper grooves 14*a* extend toward the rear. In the rear of the upper groove 14*a* a slit-like first contact-fitting hole 16*a* is formed penetrating the rear wall 16 and continuing from the upper groove 14*a*. This slit-like first contact-fitting hole 16*a* accepts the contact portion 71 of a first contact 70. By pressure-fitting the fixed portion 73 of the first contact 70 into the first contact-fitting hole 16*a*, the first contact 70 is fixed to the connector body 10. Meanwhile, in the rear of the upper groove 14*a* a slit-like receiver 16*c* is formed continuing from the upper groove 14*a* so that a resilient deformable portion 82 of the second contact 80 can be arranged therein. Contact portion 81 of the second contact 80 fits within slit-like receiver 16*c*. The slit-like receiver 16*c* connects between the upper groove 14*a* where the contact portion 81 of the second contact 80 is arranged and the lower groove 12*a* of the bottom wall 12.

A pair of projections 22 is formed at both sides in the lower surface of the top wall 14. The projections 22 correspond to the anti-removal recesses 103 formed at the both sides of the flexible conductor 100.

Figure 5A:
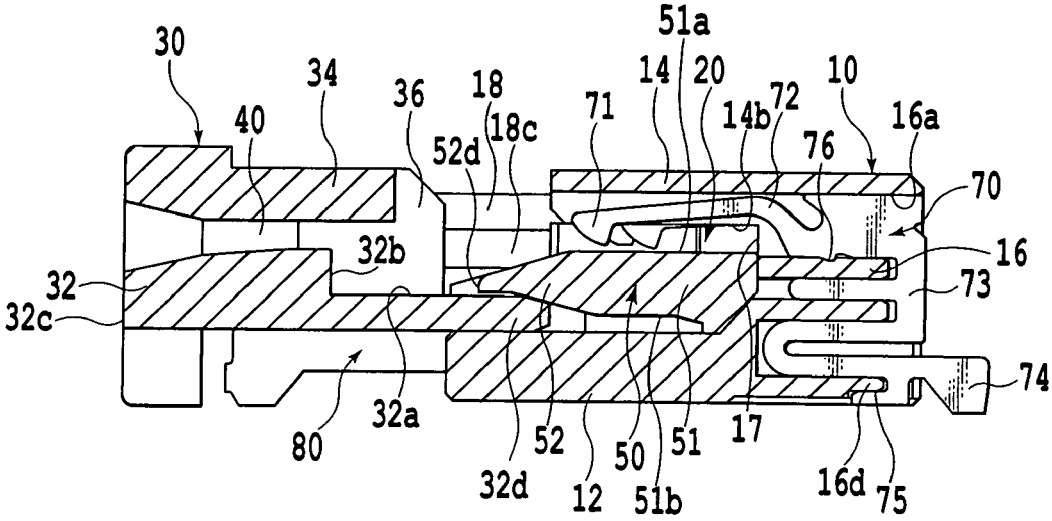
FIG. 5A is a schematic sectional view taken along V-V of the connector for a flexible conductor shown in FIG. 2, showing a state not attached with a flexible conductor.
Figure 5B:
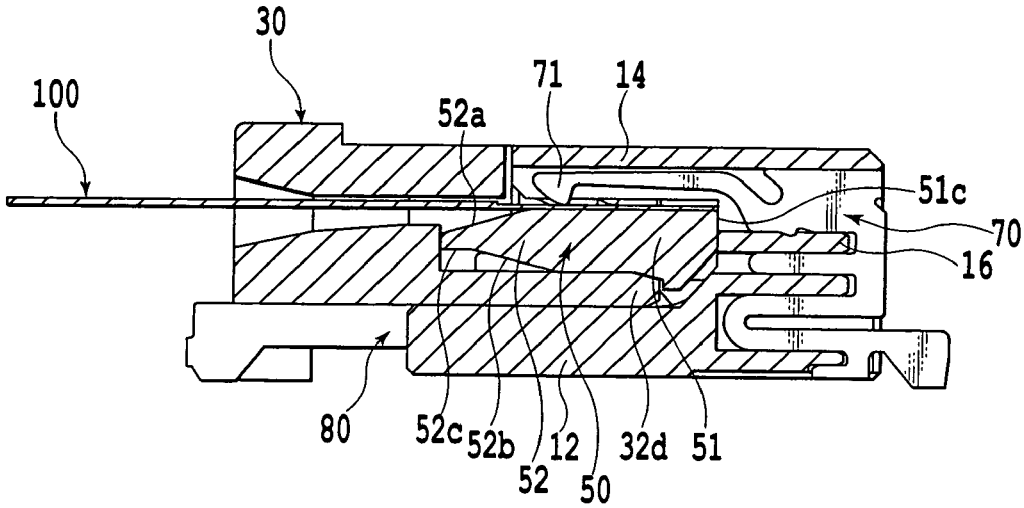
FIG. 5B is a schematic sectional view taken along V-V of the connector for a flexible conductor shown in FIG. 2 similarly to FIG. 5A, showing a state attached with a flexible conductor.

In the rear wall 16, slit-like first contact-fitting holes 16*a* are formed each continuing from the upper groove 14*a* to arrange therein the contact portion 71 of the first contact 70 and penetrating the rear wall 16. The slit-like first contact-fitting hole 16*a* preferably has a vertical length (height) greater than the depth of the upper groove 14*a*. In this embodiment, the first contact-fitting holes 16*a* each have a rear open end extending to the lower surface of the bottom wall 12 through the rear wall 16 as shown in FIGS. 5A and 5B, thus forming an engaging projection 16*d* for engagement with an engaging concavity 75 of the first contact 70. The first contact 70 is to be inserted and fixed to the connector body 10 from the rear of the rear wall 16. Incidentally, although in the embodiment there are formed the plurality of engaging holes to receive some engaging convexes of the first contacts 70 as shown in FIGS. 5A and 5B, those may be omitted in a certain case.

Meanwhile, in the rear wall 16, slit-like second contact-fitting holes 16*b* are formed each continuing from the lower groove 12*a* to arrange therein the fixed portion 83 of the second contact 80, in a manner penetrating the rear wall 16. Incidentally, the slit-like second contact-fitting hole 16*b* must not penetrate the rear wall 16. Furthermore, in the front of the rear wall 16, slit-like receiver 16*c* are formed each connecting between the upper groove 14*a* to arrange therein the contact portion 81 of the second contact 80 and the lower groove 12*a* to arrange therein the fixed portion 83 of the relevant second contact 80, to receive the resilient deformable portion 82 of the second contact 80. Furthermore, the rear wall 16 has a front surface formed vertically as a guide surface 17. The vertical guide surface 17 is to abut against a tip of the flexible conductor 100 inserted and a rear surface 51*c* at the rear end of the operator 50, referred later. So, the vertical guide surface 17 can guide the flexible conductor 100 and the operator 50 for their vertical movements.

A pair of right and left sidewalls 18, 18 is respectively formed with a pair of first engaging portions 18*a*, 18*a* and a pair of second engaging portions 18*b*, 18*b*, as shown in FIGS. 1 and 2. The pair of first engaging portions 18*a*, 18*a* is respectively to engage with a pair of first engaging claws 53, 53 formed in the operator 50, so that the operator 50 can be guided for its vertical movement. Meanwhile, the pair of second engaging portions 18*b*, 18*b* is to engage with a pair of second engaging claws 37, 37 formed in the slider 30, to prevent the slider 30 from being removed out of the connector body 10. Incidentally, reference numeral 18*c* designates a pair of guide grooves for horizontally guiding the engaging claw 36 of the slider 30 in the front and rear direction. The guide grooves 18*c* respectively extend rearward, by a predetermined amount, relative to the pair of second engaged portions 18*b*, 18*b*.

Each of the first contacts 70 roughly includes a contact portion 71, a resilient deformable portion 72, a fixed portion 73, a terminal portion 74 and an engaging concavity 75, as shown in FIGS. 5A and 5B.

The contact portion 71 is a member for contact with the first external terminal 105 of the flexible conductor 100 inserted in the connector 1. Contact portion 71 is formed generally in a downward V-form at the tip of the resilient deformable portion 72 extending forward from the fixed portion 73. The fixed portion 73 is formed with an engaging projection 76. By pressure-fitting the fixed portion 73 together with the engaging projection 76 in the first contact-fitting hole 16*a* of the connector body 10 as stated before, the first contact 70 is fixed to the connector body 10. A terminal portion 74 is a member to be connected, by soldering or so, to an external terminal of an electronic appliance on which the connector 1 is to be mounted. This extends rearward (and downward, in this embodiment) from the fixed portion 73. The engaging concavity 75 is a member to engage with the engaging projection 16*d* formed in the lower surface of the rear wall 16 of the connector body 10 (i.e. in the lower surface of the bottom wall 12). This is preferably formed close to the terminal portion 74. By engaging the engaging concavity 75 with the engaging projection 16*d*, it prevents the first contact 70 from moving horizontally and maintains first contact 70 in position. In addition, by the arrangement of engaging concavity 75 close to the terminal portion 74, the terminal portion 74 is prevented from moving vertically.

The second contacts 80 each have constituent parts similarly to the first contact 70. Specifically, the second contact 80 includes a contact portion 81, a resilient deformable portion 82, a fixed portion 83, a terminal portion 84 and an engaging concavity 85, as shown in FIGS. 4A and 4B. The contact portion 81 is a member to contact with the second external terminal 104 of the flexible conductor 100 inserted in the connector 1. This is formed generally in a downward V-form at the tip of the resilient deformable portion 82 extending upward and forward from the fixed portion 83. The fixed portion 83 is formed with an engaging projection 86, in a position close to the proximal end. By pressure-fitting its proximal end of the fixed portion 83 together with the engaging projection 86 into the second contact-fitting hole 16*b* of the connector body 10, the second contact 80 is fixed to the connector body 10. The terminal portion 84 is a member to be connected, by soldering or so, to the external terminal of an electronic appliance on which the connector 1 is to be mounted. This is provided in the fixed portion 83, in a position close to the front end. The engaging concavity 85 is configured to engage with the engaging projection 12*b* formed in the lower surface of the bottom wall 12 of the connector body 10. This is preferably formed in a position close to the terminal portion 84. Engaging the engaging concavity 85 with the projection 12*b*, it prevents the second contact 80 from moving horizontally and positions the second contact 80 in position.

Meanwhile, by arranging the engaging concavity 85 in a position close to the terminal portion 84, the terminal portion 84 is prevented from moving vertically.

The first contact 70 is inserted forward and fixed in the connector body 10 from the rearward thereof, through the first contact-fitting hole 16*a* provided upper in the rear wall 16 of the connector body 10. Meanwhile, the second contact 80 is inserted rearward and fixed in the connector body 10 from the forward thereof, through the second contact-fitting hole 16*b* provided lower in the rear wall 16 of the connector body 10. The first contacts 70 and the second contacts 80 are fixed alternately and parallel with each other in the connector body 10. As a result, by arranging the contact-fitting holes 16*a*, 16*b* in a staggered form, a multiplicity of contacts can be arranged without increasing the size of the connector body 10. This does not reduce the strength of the rear wall 16 of the connector body 10. Meanwhile, the contact portions 71 of the first contacts 70 and the contact portions 81 of the second contacts 80 are arranged in a staggered form correspondingly to the first and second external terminals 105, 104 of the flexible conductor 100 to be inserted in the connector 1.

The operator 50 is basically arranged within the space 20 of the connector body 10, and moves vertically between a first position (see FIGS. 4A, 5A, etc.) lower in the space 20 and a second position (see FIGS. 4B, 5B, etc.) higher in the space. By moving the operator 50 immediately above from the first position to the second position cooperatively with the slider 30 referred later, the flexible conductor 100 being inserted is pushed up, thereby placing the first and second external terminals 105,106 of the flexible conductor 100 into contact with the corresponding first and second contacts 70, 80. Simultaneously, the operator 50 causes the anti-removal recess 103 formed in the flexible conductor 100 to be engaged on the anti-removal projection 22 formed projecting in the lower surface of the top wall 14 of the connector body 10. By further moving the operator 50 from the first position to the second position, the grounding contact 90 is pushed up into contact with the grounding external terminal (not shown) formed in the backside (i.e. surface opposite to the surface where the first and second external terminals 105,104 are formed) of the flexible conductor 100.

The operator 50 includes an operator's proximal portion 51 and an operator's distal portion 52. Although the description explains the operator's proximal portion 51 and the operator's distal portion 52 separately, those are actually formed in one body. Namely, the operator 50 in the embodiment is a single member.

The operator's proximal portion 51 has a horizontal upper surface 51*a* serving as a first push surface to push up the flexible conductor 100 inserted, a horizontal lower surface 51*b* parallel with the upper surface 51*a* and a rear surface 51*c* nearly vertical to abut against the guide surface 17 of the rear wall 16 of the connector body 10. In the both sides of the horizontal upper surface 51*a*, a pair of recesses 54, 54 are formed having push projections 54*a*, 54*a* serving as a pair of second push surfaces. The pair of recesses 54, 54 is formed corresponding to a pair of grounding contacts 90, 90 provided in the connector body 10 at the both sides thereof. The recesses 54 are each structured to receive at least the contact portion 91 of the grounding contact 90. In the both sides of the horizontal upper surface 51*a*, there are further formed a pair of anti-removal holes 55, 55 in positions outer than the pair of recesses 54, 54. The pair of anti-removal holes 55, 55 corresponds to a pair of anti-removal recesses 103, 103 of the flexible conductor 100 to insert.

Meanwhile, in the both sides of the operator's proximal portion 51, a pair of engaging claws 53, 53 is formed to engage with the first engaged portions 18*a*, 18*a* of the connector body 10. Incidentally, the operator's proximal portion 51, at its distal side, is formed with the operator's distal portion 52 in a projecting fashion.

The operator's distal portion 52 has a first slanted surface 52*a* descending from the horizontal upper surface 51*a* of the operator's proximal portion 51 toward the distal end thereof, a second slanted surface 52*b* ascending from the horizontal lower surface 51*b* of the operator's proximal portion 51 toward the distal end thereof, a horizontal surface 52*c* extending continuing from the second slant surface 52*b* toward the distal end and a vertical distal surface 52*d* connecting between the first slant surface 52*a* and the second slant surface 52*b*.

In the both sides of the operator's distal portion 52, a pair of hooks 59, 59 is formed having an L-form in section capable of moving in a pair of guide elongate holes 38, 38 of the slider 30, referred later. The pair of hooks 59, 59 is formed extending from the pair of engaging claws 53, 53 toward the distal end, as shown in FIGS. 1 and 2.

Explanation is now made of the slider 30. The slider 30 is movable between a first position (see FIGS. 4A, 5A, etc.) where pulled out of the space 20 and a second position (see FIGS. 4B, 5B, etc.) where pulled in the space 20, along the bottom wall 12 within the space 20 of the connector body 10. By moving the slider 30 to the second position, the operator 50 is moved up to the second position to thereby bring the external terminals 105, 104 of the inserted flexible conductor 100 into contact with the first and second contacts 70, 80. The slider 30, or driver, acts to forcibly move the operator 50.

The slider 30 includes a bottom wall 32, a top wall 34, right and left sidewalls 36, 36 and a passage 40 surrounded by the bottom wall 32, the top wall 34 and the right and left sidewalls 36, 36.

As shown in FIGS. 4A and 5A, the bottom wall 32 has a region constituting a part of the passage 40 where the flexible conductor 100 is to enter and exit. This region extends from the distal end 32*c* of bottom wall 32 to the wall's intermediate portion. The bottom wall 32, in a region constituting the passage 40, preferably has an upper surface established at the nearly same height as the horizontal upper surface 51*a* of the operator 50 lying in the first position when the slider 30 is in the first position. The bottom wall 32 has an intermediate portion formed with a vertical abutment surface 32*b* directing downward so that it can abut against the distal surface 52*d* of the operator 50 when the slider 30 is pushed into the second position in the connector body 10. A push-up surface 32*a* is formed, one-state lower than the passage 40, in a region of the bottom wall 32 from the position the abutment surface 32*b* is formed toward the proximal end 32*d*. When the slider 30 moves from the first position to the second position, the push-up surface 32*a* moves below the operator 50 and raises the operator 50 from the first position to the second position. Accordingly, a distance that operator 50 rises is established by the thickness of the bottom wall 32 in a portion of the push-up surface 32*a*. Meanwhile, a longitudinal length (a horizontal length or a length between the abutment surface 32*b* and the proximal end 32*d*) of the push-up surface 32*a* of the bottom wall 32 is established such that the proximal portion of the push-up surface 32, i.e. the proximal end 32*d* of the bottom wall 32, is in a position forward of the contact portion 71 of the first contact 70 when the slider 30 is in the first position, and in a position to the rear of the contact portion 81 of the second contact 80 when the slider 30 is pushed to the second position in the connector body 10. Furthermore, the abutment surface 32*b* of the bottom wall 32 is established to abut against the distal surface 52*d* of the operator 50 when the slider 30 is in the second position. Incidentally, by reducing the distance between the abutment surface 32*b* of the slider 30 lying in the first position and the distal surface 52*d* of the operator 50, the flexible conductor 100 can be prevented from being caught between the abutment surface 32*b* and the distal surface 52*d* and being buckled when the slider 30 moves from the first position to the second position.

A pair of elongate guide holes 38 penetrate both sides of the bottom wall 32 adjacent to and within the sidewalls 36, 36. These elongate guide holes 38 are formed close to the proximal end of the push-up surface 32*a* of bottom wall 32. Each elongate guide hole 38 is formed as a rectangular hole long in the longitudinal direction (or in the front and rear direction). The pair of elongate guide holes 38, 38 is to be fitted with the pair of hooks 59, 59 of the operator 50. The hooks 59 are allowed to move in the front and rear direction (i.e. longitudinally) along the elongate guide holes 38. The elongate guide hole 38 has a depth nearly equal to the longitudinal thickness that the hook 59 adds to the moving distance of the slider 30. By such a structure, the operator 50 is restricted from moving right and left relative to the slider 30. Hence, the operator 50 is free from oscillating right and left during the movement of the slider 30 from the first position to the second position. Namely, the push-up surface 32*a* of the slider 30 is to push up the operator 50 uniformly and correctly from the first position to the second position. As a result, when the flexible conductor 100 is on the horizontal upper surface 51*a* of the operator 50, electrical contacting is provided positively between the external terminals 105, 104 of the flexible conductor 100 and the contact portions 71, 81 of the contact.

The top wall 34 constitutes a part of the passage 40. The top wall 34 has a longitudinal length established such that the proximal tip of the top wall 34 does not abut against the distal end of the top wall 12 of the connector body 10 when the slider 30 is pushed in the connector body 10. Meanwhile, a pair of observation windows 42, 42 may be formed in the both sides of the top wall 34 so that the flexible conductor 100 attached can be confirmed. Furthermore, such observation windows may be provided in the bottom wall 32, in positions corresponding to the windows 42 of the top wall 34 (see FIGS. 6A and 6B).

In the outer surfaces of the right and left sidewalls 36, 36, a pair of second engaging claws 37, 37 is formed to engage with the pair of second engaged portions 18*b*, 18*b* provided in the connector body 10. Flanges 44 are formed in the right and left sidewalls 36, 36 in positions close to the distal end thereof.

In FIG. 1, reference numeral 46 designates an insertion aperture, for a flexible conductor 100, formed in the slider 30 in a position close to the distal end thereof. The insertion aperture 46 is in communication with the passage 40. The insertion aperture 46 is preferably structured in a manner gradually increasing in size from the passage 40 as shown in FIGS. 3, 4A, etc. in order to facilitate the insertion of the flexible conductor 100.

Finally, explanation is now made of the grounding contacts 90. The grounding contacts 90 are provided in pairs at the both sides of the connector body 10 (see FIG. 3). Each grounding contact 90 has roughly a contact portion 91, a resilient deformable portion 92, a fixed portion 93 and a terminal portion 94, as shown in FIGS. 6A and 6B. The grounding contact 90 is to be attached to the connector body 10 by fixing the fixed portion 93 to the hole 16*f* formed in the rear wall of the connector body 10, similarly to the first contact 70.

The grounding contact 90 is structured such that its contact portion 91 is received in the recess 54 of the operator 50. The grounding contact 90 is supported, at its intermediate portion that continues from the contact portion 91 of the grounding contact 90 to the resilient deformable portion 92, by the push projection 54*a* serving as a second push surface formed at the distal end of the recess 54 in the operator 50. With this structure, when the operator 50 rises to the second position, the contact portion 91 is rotated about a point supported by the push projection 54*a* and simultaneously moved up. Due to this, the grounding contact 90 at its contact portion is allowed to project upward out of the recess 54 of the operator 50.

Explanation is now made of the operation to attach the flexible conductor 100 to and remove it from the connector 1 for a flexible conductor according to the embodiment.

In FIG. 3, 4A, 5A, 6A or 7A, there is shown a stand-by state of the connector 1 for a flexible connector, i.e. state before attaching a flexible conductor 100. The slider 30 is in the first position wherein it is pulled out to the limit toward the distal end relative to the connector body 10. The operator 50 is also in the first position lower within the space 20 of the connector body 10. At this time, the proximal end 32*d* of the bottom wall 32 of the slider 30 is positioned below the horizontal surface 52*c* and second slant surface 52*b* of the operator's distal portion 52. Meanwhile, the horizontal upper surface 51*a* of the operator 50 is positioned below by a distance somewhat greater than the thickness of the flexible conductor 100, relative to the contact portion 71 of the first contact 70 and the contact portion 81 of the second contact 80 that are in a state no biasing force is applied, i.e. in a relaxed state. Meanwhile, the grounding contact 90 received in the recess 54 of the operator 50 is in a relaxed state, as shown in FIG. 6A. Furthermore, the projection 22 of the connector body 10 and the anti-removal hole 55 of the operator 50 are opposed with a predetermined spacing, as shown in FIG. 7A.

In this state, the flexible conductor 100 is inserted in the slider 30 through the insertion aperture 46. The flexible conductor 100 is inserted until its tip goes into abutment against the guide surface 17 of the rear wall 16 of the connector body 10. Because the passage 40 of the slider 30 assuming the first position is nearly equal in height to the horizontal upper surface 51*a* of the operator 50 assuming the first position as noted before, the flexible conductor 100 is passed through the passage 40 of the slider 30 and guided to the first slant surface 52*a* and horizontal upper surface 51*a* of the operator 50, to smoothly reach the guide surface 17 without being deformed. At this time, the anti-removal recess 103 of the flexible conductor 100 is aligned vertically with the projection 22 of the connector body 100 and the anti-removal hole 55 of the operator 50.

When the flexible conductor 100 is in abutment against the guide surface 17 and rested upon the horizontal upper surface 51*a* of the operator 50, the slider 30, or driver, is pushed from the first position to the second position into the space 20 of the connector body 10 by utilization of the flange 44 of the slider 30. The bottom wall 32 of the slider 30 is moved along the upper surface of the bottom wall 12 of the connector body 10. The push-up surface 32*a* of the bottom wall 32 of the slider 30 goes from the position under the second slant surface 52*b* of the operator's distal portion 52, to the position under the lower surface 51*b* of the operator's proximal portion 51. Therefore the proximal end 32*d* of the bottom wall 32 of the slider 30 can be positioned under the horizontal lower surface 51*b* of the operator's proximal portion 51 of the operator 50. Due to this, the operator 50 rises from the first position to the second position, along the guide surface 17 of the rear wall 16 of the connector body 10 at which the rear end surface 51*c* of the operator's proximal portion 51 abuts.

When the slider 30, or driver, is completely pushed in the space 20 of the connector body 10, i.e. when the slider 30, or driver, reaches its second position, the operator 50 also reaches its second position as shown in FIGS. 4B and 5B. At this time, the horizontal upper surface 51*a*, or a first push-up surface, of the slider 30 pushes up the flexible conductor 100 against the first and second contacts 70, 80. Due to this, the first and second external terminals 105, 104 of the flexible conductor 100 can be positively brought into electrical contact respectively with the contact portion 71 of the first contact 70 and the contact portion 81 of the second contact 80.

Meanwhile, as shown in FIG. 6B, the contact portion 91 of the grounding contact 90 is also pushed up against its spring force by the rise of the push projection 54 of the operator 50. Due to this, the contact portion 91 of the grounding contact 90 pushes the flexible conductor 100 onto the lower surface 14*b* of the top wall 14 of the connector body 10. As a result, the grounding external terminal of the flexible conductor 100 can be positively brought into electrical contact, at a predetermined contact pressure, with the contact portion 91 of the grounding contact 90.

Furthermore, as shown in FIG. 7B, as the operator 50 moves up, the projection 22 of the connector body 10 passes the anti-removal recess 103 of the flexible conductor 100 and engages with the anti-removal hole 55 of the operator 50. This prevents the flexible conductor 100 from being removed out of the connector body 10.

As described above, by the horizontal movement of the slider 30, or driver, from the first position to the second position, as well as the vertical movement of the operator 50 from the first position to the second position due to that horizontal movement, the flexible conductor 100 is completely attached to the connector 1.

In order to remove the flexible conductor 100 attached on the connector 1, it is satisfactory to conduct a reverse operation to the foregoing of upon attaching the flexible conductor 100. This is explained briefly.

For example, in the state shown in FIG. 4B, the slider 30, or driver, is pulled from the second position to the first position. Namely, the slider 30 lying in the space 20 of the connector body 10 (specifically, proximal end 32*d* of the bottom wall 32 of the slider 30) is pulled out into the state shown in FIG. 4A. By pulling the bottom wall 32 of the slider 30 from the below of the operator 50, the operator 50 also returns from the second position to the first position. The operator 50 is pushed down by its own weight and the downward biasing force of the first and second contacts 70, 80. The operator 50 ceases from descending at the position where the biasing force of the first and second contacts 70, 80 becomes inactive. Namely, the operator 50 comes to rest at the first position. At this time, the flexible conductor 100 lying over the horizontal upper surface 51*a* of the operator 450 is in a descent position. Simultaneously, the grounding contact 90 also returns to the former position for relaxation. Furthermore, the anti-removal recess 103 of the flexible conductor 100 is in disengagement from the projection 22 of the connector body 10. In this state, by pulling the flexible conductor 100 toward the distal direction of the connector 1, the flexible conductor 100 can be easily removed out of the connector 1. FIG. 4A also shows a state that the flexible conductor 100 is removed out of the connector 1.

Second Embodiment

Figure 9:
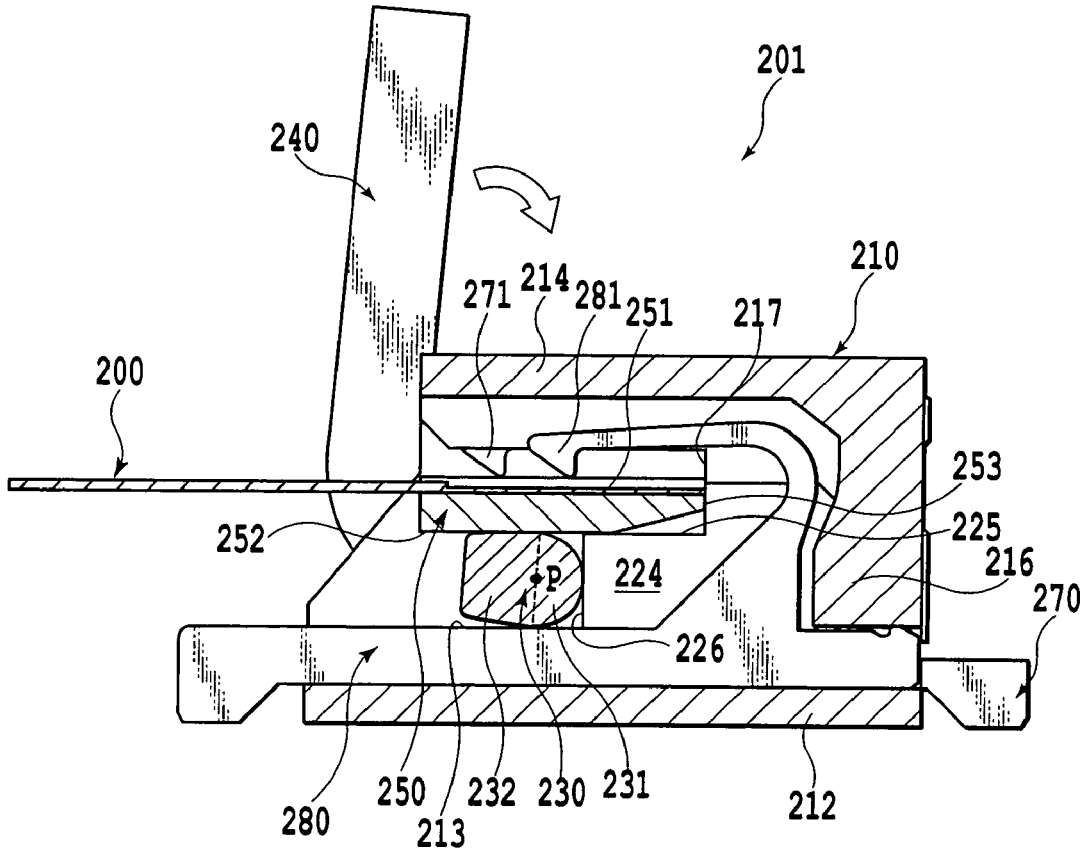
FIG. 9 is a schematic sectional view, similar to FIG. 4A, of a connector for a flexible conductor according to a second embodiment, showing a state the operator is in a first position.
Figure 10:
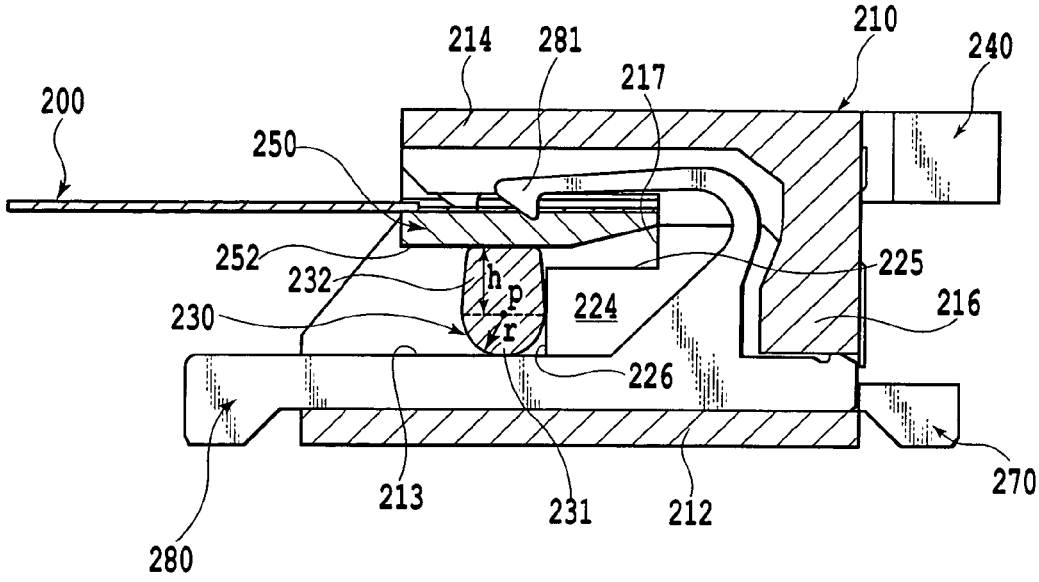
FIG. 10 is a schematic sectional view of a connector for a flexible conductor shown in FIG. 9, showing a state the operator is in a second position.

FIGS. 9 and 10 show a second embodiment according to the invention. FIG. 9 is a schematic sectional view of a connector similar to the FIG. 4 sectional view that the operator is in the first position. FIG. 10 is a schematic sectional view of a connector similar to FIG. 4 that the operator is in the second position.

This embodiment greatly differs from the first embodiment in that its connector 201 has a cam body 230, as a driver, in place of the slider 30. The connector 201 also has a somewhat difference in the structure of an operator 250 and a rear wall 216 of the connector body 210. The connector 201 however is nearly the same in structure as the first embodiment except the above structures. Accordingly, this embodiment makes a description centering on the operator 250 and the cam body 230 for driving the operator 250.

The operator 250, in this embodiment, also moves vertically between the first and second positions, like operator 50 of the foregoing first embodiment. The operator 250 in the second embodiment is formed only with the component corresponding to the operator's proximal portion 51 of the first embodiment. Namely, the operator 250 has a plate-like form with a nearly-rectangular section, including a flat horizontal upper surface 251 to rest thereon a flexible conductor 200, a bottom surface 252 nearly parallel with the horizontal upper surface 251 and in abutment against the cam body 230, and a vertical rear end surface 253. The operator 250 in the first position is supported by the cam body 230 assuming its first position, and a horizontal surface 225 structuring a step 224 protruding a proper length toward the cam body 230 from a guide surface 217 of a rear wall 216 of the connector body 210.

The operator 250 at its rear end surface 253 is vertically guided along the vertical guide surface 217 of the rear wall 216 of the connector body 210, similar to the first embodiment, to move between the first and second positions. Although not shown, the operator 250 further has a pair of engaging claws, formed at the both sides thereof, which are engaged with the first engaged portions provided at the both sides of the connector body 210, to be vertically guided, similar to the first embodiment.

The cam body 230, characterizing the embodiment, is to rotate from the first position shown in FIG. 9 to the second position shown in FIG. 10. Due to the rotation, the operator 250 vertically moves from its first to second position.

The cam body 230 is formed by a semicircular cylinder portion 231 having a generally semicircular section and a rectangular column portion 232 having a generally rectangular section. The cam body 230 rotates about a rotation center P of the semicircular cylinder portion 231. The cam body 230 is coupled to an operation lever 240 provided outside of one side of the connector body 10. By rotating the operation lever 240 in the arrow direction shown in FIG. 9 (clockwise), the cam body 230 is structurally rotated in the same direction.

The semicircular cylinder portion 231 of the cam body 230 is supported by a vertical surface 226 comprising a step 224 protruding from the guide surface 217 of the rear wall 216 of the connector body 210 and an upper surface 213 of the bottom wall 212 of the connector body 210. Accordingly, the semicircular cylinder portion 231 of the cam body 230 rotates along those surfaces 226, 213.

The cam body 230, or driver, is positioned under the operator 250. The cam body 230 can be rotated from the first position to the second position as noted before. In the first position, the cam body 230 is in a lying state as shown in FIG. 9. Namely, the rectangular column portion 232 is by the side of the semi-circular cylinder portion 231. In the second position, the cam body 230 is in a standing state as shown in FIG. 10. Namely, the rectangular column portion is above the semi-circular cylinder portion 231. Accordingly, the cam body 230 has a rotation angle of nearly 90 degrees between the first and second positions.

As shown in FIG. 10, provided that the semi-circular cylinder portion has a semi-circular radius r and the rectangular column portion has a rectangular height h, the relationship h>r is held. The difference (h−r) between h and r is established as a distance between the first and second positions of the operator 250 (in other words, movement amount of the operator 250). Meanwhile, because the operator 250 lying in its first position is held by the cam 230 in its first position as well as the step 224, the height of the horizontal surface 225 of the step 224 relative to the bottom wall upper surface 213 is nearly equal to the diameter (=2r) of the semi-circular cylinder portion 231 of the cam body 230.

In the embodiment, the flexible conductor 200 is to be attached to the connector 201 as in the following manner. Note that the corresponding elements to those of the first embodiment are omitted of description in order to avoid duplicated descriptions.

As shown in FIG. 9, the flexible conductor 200 is to be inserted into the space of the connector body 210 through between the top wall 214 of the connector body 210 and the horizontal upper surface 251 of the operator 250. Subsequently, the flexible conductor 200 is passed through between the respective contact portions 271, 281 of the first and second contact 270, 280 and the horizontal upper surface 251 of the operator 250, and inserted into an abutment against the guide surface 217 of the rear wall 216 of the connector body 210. By thus abutting the flexible conductor 200 against the guide surface 217, the flexible conductor 200 is placed in a state resting upon the horizontal upper surface 251 of the operator 250 taking the first position and the horizontal surface 225 of the step 224.

In this state, by rotating the operation lever 240 clockwise by 90 degrees, the cam body 230, or driver, is rotated from the first position to the second position. This causes the operator 250 to be raised vertically to a position supported on the cam body 230 standing in state, i.e. to the second position. Due to this, the external terminals of the flexible conductor 200 are brought into electric contact, at a predetermined contact pressure, with the contact portion 271 of the first contact 270 and the contact portion 281 of the second contact 280.

By the operation so far described, the connector 201 in this embodiment is allowed to positively mount the flexible conductor similarly to the first embodiment. Incidentally, upon removal, it is satisfactory to make an operation in the reverse order.

The present invention has been described in detail with respect to preferred embodiments, and it will now be apparent from the foregoing to those skilled in the art that changes and modifications may be made without departing from the invention in its broader aspect, and it is the intention, therefore, in the appended claims to cover all such changes and modifications as fall within the true spirit of the invention.

What is claimed is:

1. A connector for a flexible conductor, comprising:

a connector body;

a plurality of contacts provided in the connector body;

an operator capable of vertically moving between a first lower position and a second upper position within the connector body; and a driver capable of moving between a first position and a second position, relative to the connector body;

wherein the driver causes the operator to move vertically between the first and second positions correspondingly to a movement thereof between the first and second positions;

the operator, in the first position, allows a flexible conductor to be placed between the operator and the plurality of contacts, and, in the second position, allows the external terminals of the flexible conductor to be in contact, at a predetermined contact pressure, with the plurality of contacts; and the operator has a horizontal upper surface serving as a push surface to push the flexible conductor placed thereon toward the contact and the operator has a horizontal lower surface under which the driver can be positioned parallel with the horizontal upper surface.

2. A connector for a flexible conductor as claimed in claim 1, wherein the driver is a slider capable of moving horizontally relative to the connector body.

3. A connector for a flexible cable as claimed in claim 1, wherein the driver is a cam body capable of rotating relative to the connector body.

4. A connector for a flexible conductor as claimed in claim 1, wherein the plurality of contacts include first and second contacts whose contact positions differ in the position in the forward and rearward direction and the first contact and second contacts are arranged alternately.

5. A connector for a flexible conductor as claimed in claim 1, wherein the driver includes a passage that allows the flexible conductor to be inserted into the connector; and when the driver occupies the first position, a surface of the passage lies in substantially the same plane as the horizontal upper surface of the operator.

6. The connector of claim 1, wherein the operator is configured in the second position to prevent removal of the flexible conductor from the connector body.

7. A connector for a flexible conductor, comprising a connector body;

a plurality of contacts provided in the connector body;

a grounding contact provided in the connector body;

an operator capable of vertically moving between a first upper position and a second lower position, within the connector body; and a driver capable of moving between a first position and a second position, relative to the connector body;

wherein the driver causes the operator to move vertically between the first and second positions due to a movement of the driver between the first and second positions;

the operator, in the first position, allows a flexible conductor to be placed between the operator and the plurality of contacts, and, in the second position, allows the external terminals of the flexible conductor to be in contact, at a predetermined contact pressure, with the plurality of contacts; and the operator includes a recess to receive the grounding contact, the operator being allowed, when in the first position, to receive the grounding contact in the recess and, when in the second position, to bring the grounding contact into contact with the grounding external terminals of the flexible connector.

8. A connector for a flexible conductor as claimed in claim 7, wherein the connector body is further formed with a projection therein, the operator being further formed with an anti-removal hole corresponding to the projection, the projection being allowed to engage in the anti-removal hole through an anti-removal concavity formed in the flexible conductor when the operator is in the second position.

9. The connector of claim 7, wherein the operator is configured in the first position to have a predetermined spacing from the plurality of contacts.

10. The connector of claim 7, wherein the operator is configured in the second position to prevent removal of the flexible conductor from the connector body.

11. A connector for a flexible conductor, comprising:

a connector body;

a plurality of contacts provided in the connector body;

an operator capable of vertically moving between a first position and a second position, within the connector body; and a driver capable of moving between a first position and a second position, relative to the connector body;

wherein the driver causes the operator to move vertically between the first and second positions correspondingly to a movement thereof between the first and second positions;

the operator, in the first position, allows a flexible conductor to be placed between the operator and the plurality of contacts, and, in the second position, allows the external terminals of the flexible conductor to be in contact, at a predetermined contact pressure, with the plurality of contacts;

wherein the operator has a horizontal upper surface serving as a push surface to push the flexible conductor placed thereon toward the contact and the operator has a horizontal lower surface under which the driver can be positioned parallel with the horizontal upper surface; and wherein the driver is a cam body capable of rotating relative to the connector body.

12. The connector of claim 11, wherein the operator is configured in the first position to have a predetermined spacing from the plurality of contacts.

13. The connector of claim 11, wherein the operator is configured in the second position to prevent removal of the flexible conductor from the connector body.

14. A connector for a flexible conductor, comprising:

a connector body;

a plurality of contacts provided in the connector body;

an operator capable of vertically moving between a first position and a second position, within the connector body; and a driver capable of moving between a first position and a second position, relative to the contact body;

wherein the driver causes the operator to move vertically between the first and second positions correspondingly to a movement thereof between the first and second positions;

the operator, in the first position, allows a flexible conductor to be placed between the operator and the plurality of contacts, and, in the second position, allows the external terminals of the flexible conductor to be in contact, at a predetermined contact pressure, with the plurality of contacts;

wherein the operator has a horizontal upper surface serving as a push surface to push the flexible conductor placed thereon toward the contact and the operator has a horizontal lower surface under which the driver can be positioned parallel with the horizontal upper surface;

wherein the driver includes a passage that allows the flexible conductor to be inserted into the connector; and when the driver occupies the first position, a surface of the passage lies in substantially the same plane as the horizontal upper surface of the operator.

15. The connector of claim 14, wherein the operator is configured in the first position to have a predetermined spacing from the plurality of contacts.

16. The connector of claim 14, wherein the operator is configured in the second position to prevent removal of the flexible conductor from the connector body.

17. The connector of claim 14, wherein the driver is a slider capable of moving horizontally relative to the connector body.

18. The connector of claim 14, wherein the driver is a cam body capable of rotating relative to the connector body.

* * * * *